United States Patent [19]

Knowlton

[11] 4,190,896

[45] Feb. 26, 1980

[54] CIRCUITS HAVING SUBSTANTIALLY PARABOLIC OUTPUT VERSUS LINEAR INPUT CHARACTERISTICS

[75] Inventor: Kenneth C. Knowlton, Plainfield, N.J.

[73] Assignee: Bell Telephone Laboratories, Incorporated, Murray Hill, N.J.

[21] Appl. No.: 939,266

[22] Filed: Sep. 5, 1978

[51] Int. Cl.[2] ..... G06G 7/26

[52] U.S. Cl. ..... 364/859; 364/851; 328/144

[58] Field of Search ..... 364/851, 852, 857, 858, 364/859, 860, 718, 719, 720, 721, 722; 328/142, 143, 144, 145

[56] References Cited

U.S. PATENT DOCUMENTS

| | | | |
|---|---|---|---|
| 3,543,288 | 11/1970 | Collings | 364/858 |
| 4,001,555 | 1/1977 | Levis et al. | 364/718 |
| 4,030,039 | 6/1977 | Fahlgren | 364/851 |
| 4,064,406 | 12/1977 | Tiemeijer | 364/858 |
| 4,147,989 | 4/1979 | Brolde | 364/852 |

*Primary Examiner*—Felix D. Gruber

*Attorney, Agent, or Firm*—Hugh Linton Logan

[57] ABSTRACT

Circuits are disclosed which have substantially parabolic output vs. linear input voltage relationships where the parabolic relationship starts anew each time a change in the input voltage reverses direction. Such circuits connected in the output paths of potentiometers make the overall combinations appear as potentiometers having extremely high resolutions.

6 Claims, 3 Drawing Figures

CIRCUITS HAVING SUBSTANTIALLY PARABOLIC OUTPUT VERSUS LINEAR INPUT CHARACTERISTICS

CROSS-REFERENCE TO RELATED APPLICATION

A patent application entitled "Digital Circuits Having Nonlinear Output Versus Input Characteristics" Ser. No. 939,498 been filed concurrently herewith by K. C. Knowlton.

BACKGROUND OF THE INVENTION

1. Field of the Invention

This invention relates to providing high resolutions to potentiometers.

2. Description of the Prior Art

The "joystick", the "tracker ball" and the Stanford Research Institute "mouse" are typical devices used for cursor positioning purposes with computer display terminals. These devices, which are described on pages 171 through 174 of *Principles of Interactive Computer Graphics* by W. M. Newman and R. F. Sproull (McGraw-Hill, 1973), typically include potentiometers. To achieve accurate positioning with such devices, it is necessary that their potentiometers have relatively high resolutions. Current techniques for increasing resolutions—such as ganged potentiometers—produce physical size increases and/or structure complexities which are not desirable in positioning devices of the above-mentioned types.

SUMMARY OF THE INVENTION

An object of the invention is to increase the resolution of a potentiometer.

Another object is to increase the resolutions of any of the above-mentioned devices without having to modify the devices per se.

These and other objects are achieved with embodiments of the invention which may take the form of integrated circuits that receive outputs from potentiometers and in turn produce outputs that make the overall combinations appear as potentiometers with high resolutions. Those circuits are not only easily added to existing potentiometers to increase their effective resolutions but may be added anywhere between the potentiometer output terminals and the ultimate circuitry utilizing their outputs. This is highly desirable with respect to the above-described positioning devices because the devices per se need not be modified.

Embodiments of the invention function to produce first and second voltage differences each time an input voltage changes in a direction opposite to that of its previous change. In particular, when the input voltage change is an increase after a previous decrease, the first and second voltage differences comprise the differences between a voltage substantially equal to the maximum possible amplitude of the input voltage and the embodiment's actual input voltage and a first voltage, respectively, at the time the input voltage begins to change. On the other hand, when the input voltage change is a decrease after a previous increase, these first and second voltage differences comprise the differences between a voltage substantially equal to the minimum possible amplitude of the input voltage and the embodiment's actual input voltage and the first voltage, respectively, at the time the input voltage begins to change.

A third voltage difference is also produced. This voltage difference is equal to the input voltage minus the value of the input voltage at the time it begins to change in a direction opposite to that in which it last changed direction.

These embodiments then function to produce a second voltage substantially equal to the square of the third voltage difference divided by the square of the first voltage difference. Finally, the second voltage is multiplied by the second voltage difference and then subtracted from the output voltage value at the time of an input voltage direction change to produce the first voltage.

In some embodiments, the first voltages comprise the embodiment output voltages. In other embodiments, the first voltage and portions of the third voltage differences are added together to produce the embodiment output voltages.

In accordance with the invention, all of these functions may be performed with structure operating either in an analog or a digital sense. As will become apparent from the following detailed descriptions of an analog embodiment and a digital embodiment, conventional circuits are used to perform these functions.

DETAILED DESCRIPTION

Figure 1:
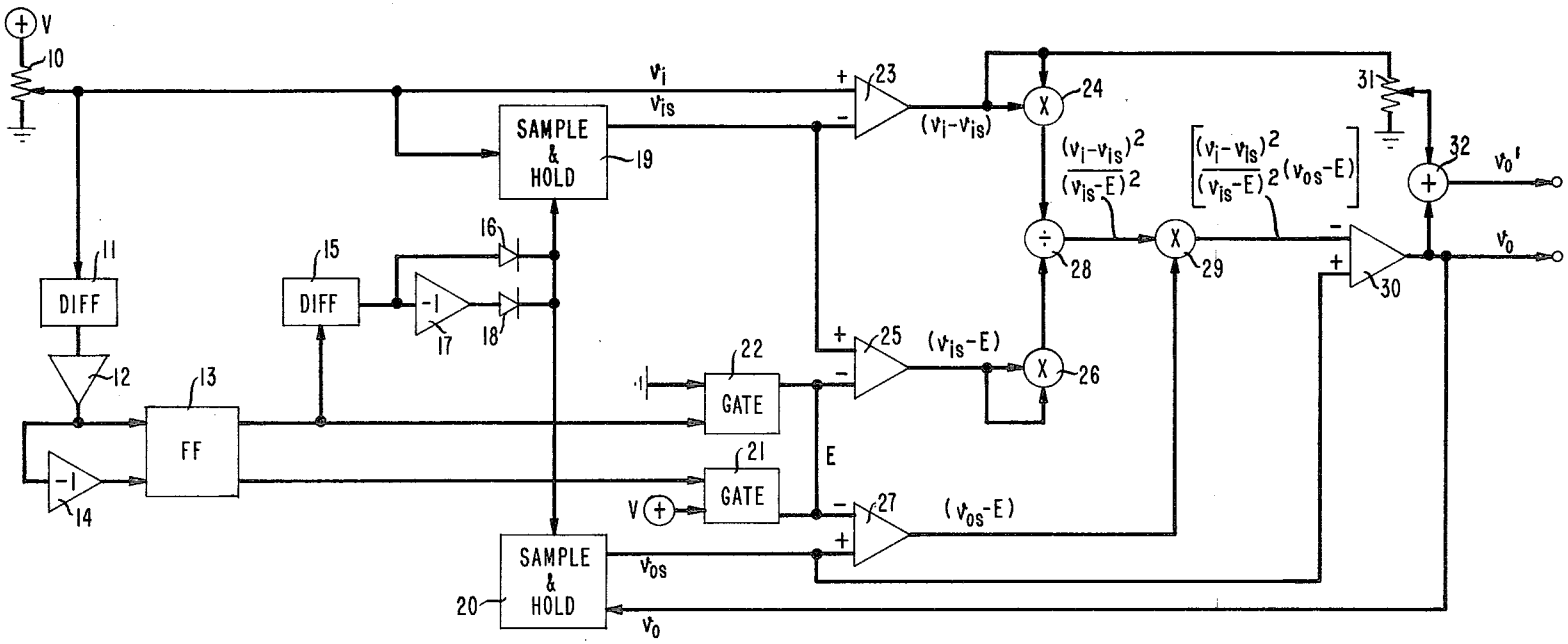
FIG. 1 is a block diagram of an analog embodiment of the invention.

FIG. 1 shows a potentiometer 10 connected between an unillustrated source of voltage +V and ground potential. The movable contact on potentiometer 10 applies an input voltage to the remaining circuitry which comprises an embodiment of the invention.

The movable contact of potentiometer 10 is connected to a differentiator 11 which in turn is connected to an amplifier 12. The output of amplifier 12 is applied directly to one input of a flip-flop 13 and to an inverting amplifier 14 whose output is applied to the other input of flip-flop 13.

Differentiator 11 produces a positive voltage whenever the movable contact on potentiometer 10 is being moved toward the +V end of the potentiometer. Conversely, a negative voltage is produced whenever the movable contact is being moved toward the ground end of the potentiometer. Flip-flop 13 is adapted to respond to positive voltages only and consequently its output state is indicative of the last direction of change of the voltage input to differentiator 11.

One output of flip-flop 13 is applied to a differentiator 15. Positive going pulses from differentiator 15 are passed by a diode 16 while negative going pulses are inverted by an amplifier 17 and passed by a diode 18. The pulses passed by diodes 16 and 18 activate sample and hold circuits 19 and 20 to sample the input voltage from potentiometer 10 and a first output voltage, respectively.

The outputs passed by diodes 16 and 18 cause the input and first output voltages to be sampled at the time flip-flop 13 changes state. The input and first output voltages are therefore sampled when the movable contact on potentiometer 10 begins to move in a direction opposite to the direction in which it was previously moved. In other words, samples are produced when the input voltage received from potentiometer 10 changes in a direction opposite to that in which it last changed.

The outputs of flip-flop 13 are applied as gating inputs to gates 21 and 22. The input lead of gate 21 is connected to +V while the input lead of gate 22 is connected to ground. The output leads of the gates are joined together with the voltage E appearing thereon being either at ground or +V potential. In particular, gate 21 is enabled when the input voltage from potentiometer 10 last changed in an increasing sense while gate 22 is enabled when the input voltage last changed in a decreasing sense.

A difference producing device 23, in the form of a differential amplifier, produces the difference between the input voltage and the last sampled value of this voltage. This resulting difference voltage is then squared by a multiplier 24.

In a similar manner, a difference producing device 25 produces the difference between the last sampled value of the input voltage and the output of gates 21 and 22, while a multiplier 26 squares the resulting difference voltage.

A third difference producing device 27 produces a voltage representing the difference between the last sampled output voltage and the output of gates 21 and 22.

A divider 28 divides the output of multiplier 24 by the output of multiplier 26 while a multiplier 29 multiplies the result produced thereby by the output of device 27. The result is then subtracted from the sampled output voltage by a fourth difference device 30 to produce the following:

$$v_o=(v_{os})-(v_i-v_{is})^2/(v_{is}-E)^2\,(v_{os}-E)$$

where $v_o$=the first output voltage, $v_{os}$=the sampled value of the first output voltage, $v_i$=the input voltage from potentiometer 10, $v_{is}$=the sampled value of the input voltage, and E=the output of gates 21 and 22 (which is either ground or +V volts).

A second output $v_o'$ is shown in FIG. 1. This output comprises the first output $v_o$ added to a fraction of the output from difference producing device 23. This is accomplished by a potentiometer 31 and a summer 32. These two outputs and their difference are now considered.

Figure 2:
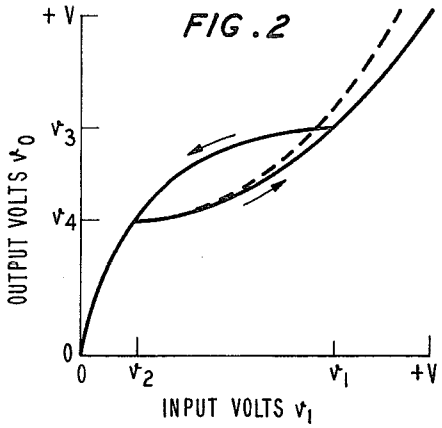
FIG. 2 shows a response curve related to the embodiment of FIG. 1.

The solid line in FIG. 2 shows output $v_o$ of the circuit of FIG. 1 as a function of input $v_i$. In FIG. 2, potentiometer 10 was previously rotated clockwise and then stopped so that the input voltage increased to voltage $v_1$. When the potentiometer is now rotated counterclockwise so that the input voltage decreases to zero, the output voltage $v_o$ (shown by the solid line) changes in a parabolic manner from $v_3$ to zero. It should be noted that there is very little change initially in the output voltage $v_o$ as a function of the input voltage (i.e., rotation of potentiometer 10). It is therefore relatively easy to adjust the potentiometer for an output voltage $v_o$ which is some vaue slightly less than $v_3$.

On the other hand, if the input voltage is decreased from $v_1$ to $v_2$ (counterclockwise rotation of potentiometer 10) and then increased in value (clockwise rotation of potentiometer 10), then the output voltage $v_o$ increases from $v_4$ toward +V in a parabolic sense. Once again it should be noted that there is very little change initially in the output voltage $v_o$ as a function of the input voltage (i.e., rotation of potentiometer 10). It is therefore relatively easy to adjust the potentiometer for an output voltage slightly greater than $v_4$.

The values of $v_1$, $v_2$, $v_3$ and $v_4$ in FIG. 2 are merely illustrative. The important point is that the flatter portion of the parabolic relationship can be made to appear at any level by selecting the level at which the input voltage reverses direction.

Output voltage $v_o$ undergoes very little change in the region of the last input voltage turnaround which may be found objectionable by some users because of a feeling of non-responsiveness. This is overcome through the addition of potentiometer 31 and adder 32 in FIG. 1. This causes a change in the response as shown by the broken line in FIG. 2. The effect of this addition is to add to the output voltage a small percentage of the input voltage change since the last reversal of the input voltage. This percentage might typically be on the order of five to ten percent—the result being a potentiometer knob which "feels" as though it has a high resolution, linear response immediately following a reversal in direction.

Figure 3:
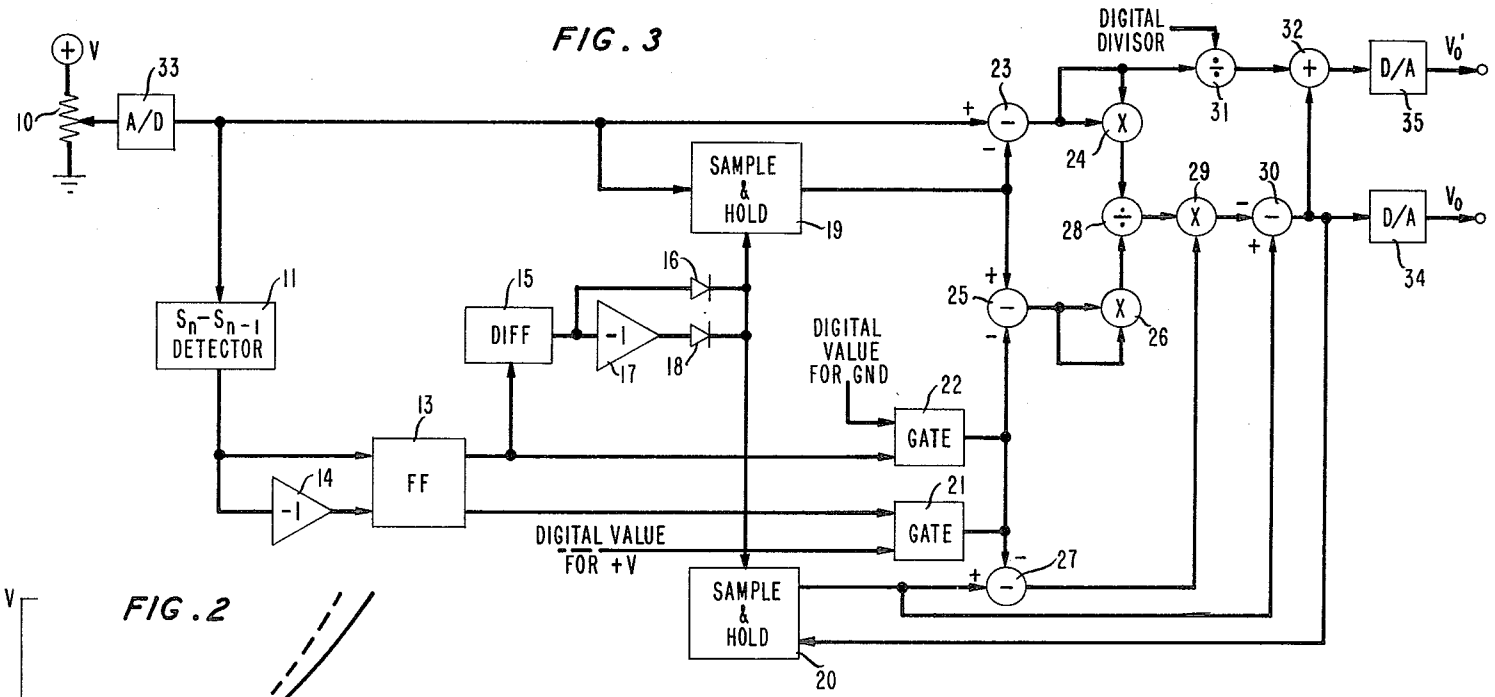
FIG. 3 is a block diagram of a digital embodiment of the invention.

FIG. 3 shows an embodiment of the invention in which the various voltages discussed with respect to FIG. 1 appear in digital form. In particular, an analog-to-digital converter 33 converts the input voltage into a digital format. Differentiator 11 is now a circuit which produces an output each time there is a difference between subsequent inputs with the output being either positive or negative depending on the nature of the difference. Sample and hold circuits 19 and 20 sample and hold the digital values of the input and first output voltages while gates 21 and 22 pass the digital values for the maximum and minimum values of the digital values of the input voltage. All of the difference, summing, multiplying and dividing elements are conventional digital circuits. Finally, the $v_o$ output and the $v_o$, output are produced in analog form as a result of digital-to-analog converters 34 and 35. The overall operation of the embodiment is identical to that of FIG. 1.

The two illustrated embodiments have been shown as receiving input voltages from potentiometers. They may however receive voltages from other sources. Furthermore, the embodiment of FIG. 3 may be made responsive to digital inputs to produce digital outputs by deleting potentiometer 10 and converters 33, 34 and 35.

I claim:

1. A circuit responsive to an input voltage for producing an output voltage nonlinearly related thereto, said circuit comprising first means (11 through 22, 25, 27) responsive each time said input voltage begins to increase, after the previous change was a decrease, for producing, until the next change is a decrease, the differences between a voltage substantially equal to the maximum possible amplitude of said input voltage and said input voltage and a first voltage, respectively, at the time said input voltage begins to increase, and, furthermore, responsive each time said input voltage begins to decrease, after the previous change was an increase, for producing, until the next change is an increase, the differences between a voltage substantially equal to the minimum possible amplitude of said input voltage and said input and first voltages, respectively, at the time said input voltage begins to decrease.

second means (23) responsive to said input voltage and to the amplitude of said input voltage at the time said input voltage begins to change amplitude in a direction opposite to that in which it last changed direction for producing the difference therebetween, third means (24, 26, 28) responsive to said second means difference output and said first means difference output involving said input voltage for producing an output equal to the square of said second means output divided by the square of said first means output involving said input voltage, fourth means (29) responsive to said first means difference output involving said first voltage and said third means output for producing an output equal to the product thereof, and fifth means (30) responsive to the amplitude of said first voltage at the time said input voltage begins to change amplitude in a direction opposite to that in which it last changed direction and also to said fourth means product output for producing the difference therebetween as both said first voltage and said circuit output voltage.

2. A circuit in accordance with claim 1 which further comprises means (31 and 32) for adding a portion of said difference produced by said second means (23) to said difference produced by said fifth means (30) to produce an output voltage which now comprises said circuit output voltage.

3. A circuit responsive to an input voltage for producing an output voltage nonlinearly related thereto, said circuit comprising first means (11 through 20) responsive to said input voltage at the time said input voltage begins to change amplitude in a direction opposite to that in which it last changed direction to sample and hold said input voltage and a first voltage, second means (21, 22) responsive each time said input voltage begins to increase, after the previous change was a decrease, for producing a voltage substantially equal to the maximum possible amplitude of said input voltage and, furthermore, responsive each time said input voltage begins to decrease, after the previous change was an increase, for producing a voltage substantially equal to the minimum possible amplitude of said input voltage, third means (23, 24) for producing the difference between said input voltage and the last sampled value thereof and the square of this difference, fourth means (25, 26) for producing the square of the difference between the last sampled value of said input voltage and the voltage output of said second means, fifth means (27) for producing the difference between the last sampled value of said first voltage and the voltage output of said second means, sixth means (28, 29) for dividing the squared output of said third means by the output of said fourth means, and furthermore, for multiplying the result produced thereby by the output of said fifth means, and seventh means (30) for subtracting the output of said sixth means from the last sampled value of said first voltage to thereby produce said first voltage and said circuit output voltage.

4. A circuit in accordance with claim 3 which further comprises means (31 and 32) for adding a portion of said difference produced by said third means (23, 24) to said difference produced by said seventh means (30) to produce an output voltage which now comprises said circuit output voltage.

5. In combination:

an input terminal for receiving an input voltage, an output terminal for making available an output voltage, first means (11, 12, 13, 14) connected to said input terminal for producing a first output during and following said input voltage changing amplitude in a first direction and a second output during and following said input voltage changing amplitude in a direction opposite to said first direction, second means (15 through 20) responsive to the changing between said first and second outputs of said first means to sample and hold said input voltage and a first voltage, third means (21) responsive to one of said outputs of said first means to produce a voltage substantially equal in amplitude to the maximum possible amplitude of said input voltage, fourth means (22) responsive to the other output of said first means to produce a voltage substantially equal to the minimum possible amplitude of said input voltage, fifth means (23, 24) for producing the difference between said input voltage and the last sampled value thereof and the square of this difference, sixth means (25, 26) for producing the square of the difference between the voltage output of said third and fourth means and the last sampled value of said input voltage, seventh means (27) for producing the difference between the voltage output of said third and fourth means and the last sampled value of said first voltage, eighth means (28, 29) for dividing the squared output of said fifth means by the output of said sixth means and, furthermore, for multiplying the result produced thereby the output of said seventh means, and ninth means (30 for subtracting the output of said eighth means from the last sampled value of said first voltage to thereby produce said first voltage which also appears on said output terminal as said circuit output voltage.

6. A circuit in accordance with claim 5 which further comprises means (31 and 32) for adding a portion of said difference produced by said fifth means (23, 24) to said difference produced by said ninth means (30) to produce an output voltage which now appears on said output terminal as said circuit output voltage.

* * * * *